US006899803B2

(12) United States Patent
Matejat et al.

(10) Patent No.: US 6,899,803 B2
(45) Date of Patent: May 31, 2005

(54) METHOD AND DEVICE FOR THE REGULATION OF THE CONCENTRATION OF METAL IONS IN AN ELECTROLYTE AND USE THEREOF

(75) Inventors: Kai-Jens Matejat, Lämmerweide (DE); Sven Lamprecht, Lessingstr (DE)

(73) Assignee: Atotech Deutschland GmbH, Berlin (DE)

( * ) Notice: Subject to any disclaimer, the term of this patent is extended or adjusted under 35 U.S.C. 154(b) by 202 days.

(21) Appl. No.: 10/169,797

(22) PCT Filed: Feb. 23, 2001

(86) PCT No.: PCT/DE01/00748

§ 371 (c)(1),
(2), (4) Date: Jul. 8, 2002

(87) PCT Pub. No.: WO01/68953

PCT Pub. Date: Sep. 20, 2001

(65) Prior Publication Data

US 2003/0000842 A1 Jan. 2, 2003

(30) Foreign Application Priority Data

Mar. 17, 2000 (DE) ..... 100 13 339

(51) Int. Cl.[7] ..... C25D 21/18; C25B 15/00

(52) U.S. Cl. ..... 205/101; 205/148; 205/291; 205/292; 205/770; 204/232; 204/233; 204/234; 204/237; 204/252; 204/263; 204/275.1; 204/295

(58) Field of Search ..... 205/101, 148, 205/291, 292, 770; 204/232, 233, 234, 237, 252, 263, 275.1, 295

(56) References Cited

U.S. PATENT DOCUMENTS 4,212,722 A 7/1980 Avedesian et al.
5,976,341 A 11/1999 Schumacher et al.
6,350,362 B1 * 2/2002 Geisler et al. ..... 205/101

FOREIGN PATENT DOCUMENTS

| | | |
|---|---|---|
| DD | DD 215 589 | 11/1984 |
| DD | DD 261 613 | 11/1988 |
| DE | 43 44 387 | 6/1995 |
| JP | 04191394 | 7/1992 |
| WO | WO 91/04359 | 4/1991 |
| WO | WO 99/10564 | 3/1999 |

OTHER PUBLICATIONS

International Search Report in PCT/DE01/00748 dated Feb. 23, 2001.

* cited by examiner

*Primary Examiner*—Robert R. Koehler
(74) *Attorney, Agent, or Firm*—Frank J. Bonini, Jr.; John F. A. Earley, III; Harding, Earley, Follmer & Frailey

(57) ABSTRACT

In order to regulate the metal ion concentration in an electrolyte fluid serving to electrolytically deposit metal and additionally containing substances of an electrochemically reversible redox system, it has been known in the art to conduct at least one portion of the electrolyte fluid through one auxiliary cell provided with one insoluble auxiliary anode and at least one auxiliary cathode, a current being conducted between them by applying a voltage. Accordingly, excess quantities of the oxidized substances of the redox system are reduced at the auxiliary cathode, the formation of ions of the metal to be deposited being reduced as a result thereof. Starting from this prior art, the present invention relates to using pieces of the metal to be deposited as an auxiliary cathode.

23 Claims, 4 Drawing Sheets

Figure 1:
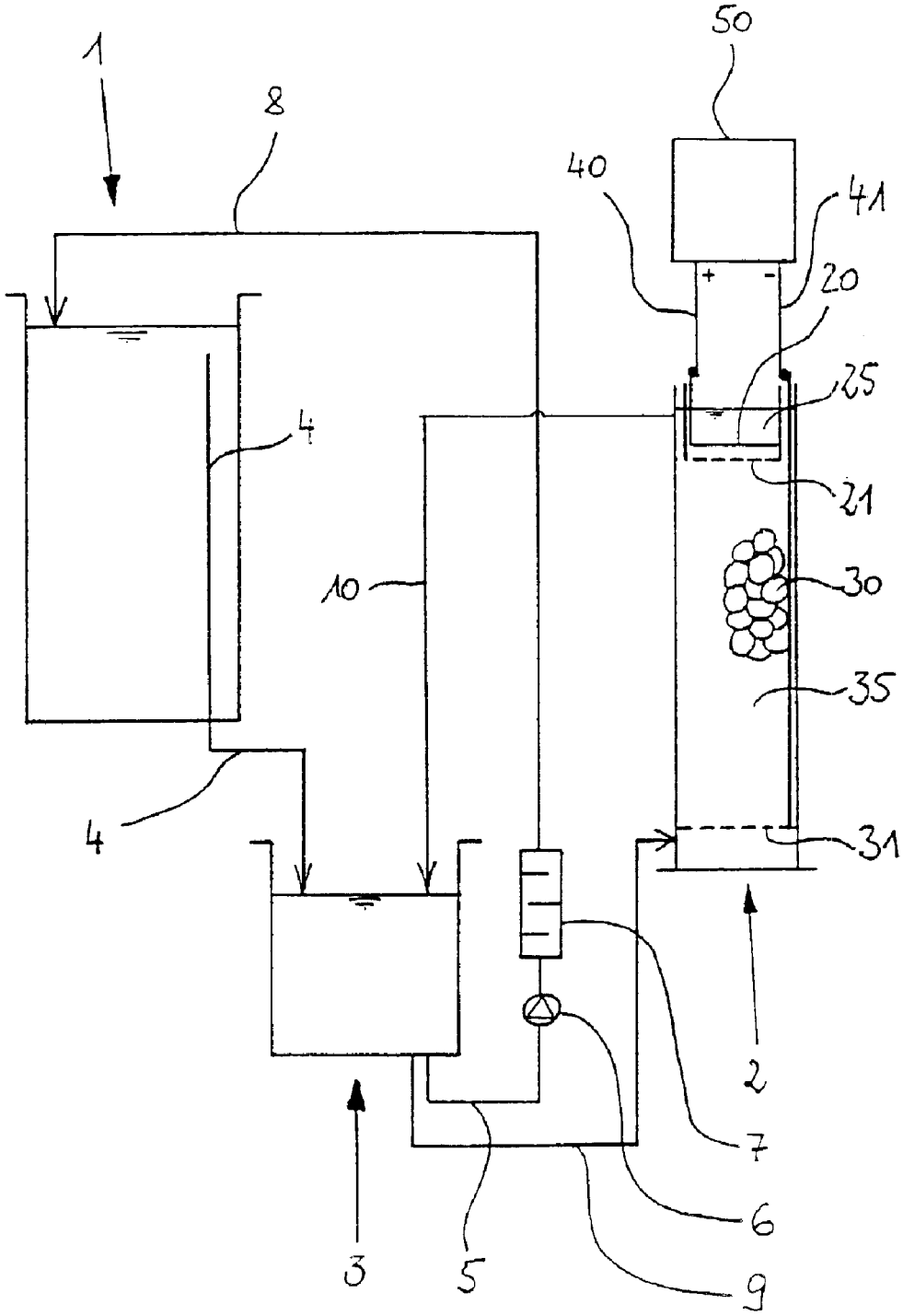

METHOD AND DEVICE FOR THE REGULATION OF THE CONCENTRATION OF METAL IONS IN AN ELECTROLYTE AND USE THEREOF

BACKGROUND OF INVENTION

1. Field of Invention

The invention relates to a method and a device for regulating the metal ion concentration in an electrolyte fluid. The method and the device may particularly be used for regulating the copper ion concentration in a copper deposition solution that serves to electrolytically deposit copper and that additionally contains Fe(II) and Fe(III) compounds.

2. Brief Description of the Related Art

When the electroplating process is performed using insoluble anodes, it must be made certain that the concentration of the ions of the metal to be deposited is kept as constant as possible within the electrolyte fluid. This may be achieved by compensating for the loss of the metal ions in the electrolyte fluid, which is caused by the electrolytic deposition of metal, by adding the corresponding metal compounds for example. However, the supply and disposal costs for this method are very high. Another well-known method for complementing the metal ions in the electrolyte fluid consists in dissolving metal directly in the fluid with the help of an oxidizing agent such as oxygen for example. For copperplating, metallic copper can be dissolved in an electrolyte fluid that has been enriched with atmospheric oxygen. In this case, ballast salts, resulting among others from the complementation with metal salts, do not enrich in the electrolyte fluid. However, in the process of electroplating, oxygen is produced in both cases at the insoluble anodes of the electrolytic cell. This oxygen attacks the organic additives in the electrolyte fluid, these additives being usually added to the electrolyte fluid for controlling the physical properties of the deposited metal coating. Additionally, the oxygen also causes the anode material to be destroyed by corrosion.

In order to avoid the formation of noxious gases such as e.g., oxygen at the insoluble anodes and by using typical sulfuric acid copperplating baths that additionally contain chloride ions, as well as of chlorine, DD 215 589 B5 proposes a method for the electrolytic deposition of metal with insoluble anodes that consists in adding substances of an electrochemically reversible redox system as additives to the electrolyte fluid, $Fe(NH_4)_2(SO_4)_2$ for example, these substances being brought, by means of an intensive forced convection with the electrolyte fluid, to the anodes, where they are electrochemically converted by the electrolytic current, upon which conversion they are led, by means of intensive forced convection, away from the anodes into a metal ion generator in which they are electrochemically converted back to their original state on regeneration metal contained in said generator while, concurrently, the regeneration metal dissolves without the help of external current and, in their original state, they are returned to the deposition tank by means of intensive forced convection. The metal ions resulting from the dissolution of metal pieces in the metal ion generator are conveyed to the electroplating plant together with the electrolyte fluid.

In this process, noxious by-products are prevented from forming at the insoluble anodes. Additionally, the metal ions that have been used up in the electrolytic deposition of metal are subsequently produced by the reaction of the appropriate metal pieces with the substance of the electrochemically reversible redox system by causing the metal pieces to oxidize with the oxidized substances and the metal ions to form.

DD 261 613 A1 describes a method that uses, for the electrolytic copper deposition, substances of an electrochemically reversible redox system such as $Fe(NH_4)_2(SO_4)_2$ wherein it indicates that organic additives which are customarily utilized in the deposition fluid for the deposition of smooth and high-gloss copper coatings are not oxidized at the insoluble anodes while conducting the method.

DE 43 44 387 A1 also describes a method for the electrolytic deposition of copper with predetermined physical properties using insoluble anodes and a copper ion generator arranged outside the electroplating cell as well as substances of an electrochemically reversible redox system in the deposition fluid, the copper ion generator serving as a regeneration space for the metal ions and containing pieces of copper. It indicates that the organic additives contained in the deposition fluid have been observed to decompose while conducting the processes described in DD 215 589 B5 and DD 261 613 A1 so that, as a result thereof, in a deposition bath being in use for a longer period of time, decomposition products of these additives would enrich in said bath. To overcome this problem it suggests to use the substances of the electrochemically reversible redox system in a concentration that precisely leads to maintaining the total content of copper required for electroplating in the electroplating plant and to conduct the electrolyte fluid inside and outside the electrolytic cell in such a manner that the life of the ions of the reversible convertible substance that have been formed by oxidation at the anodes of the electrolytic cell is so limited in time in the overall electroplating plant that these ions are prevented or at least drastically hindered from destroying the additives.

The problem with the methods and devices mentioned is that the metal content in the electrolyte fluid cannot be kept constant easily. As a result thereof, the conditions for deposition vary, thus rendering it impossible to achieve reproducible conditions for the electrolytic deposition. One of the causes for the modification of the metal content in the electrolyte fluid is that the metal pieces in the metal ion generator are not only formed under the influence of the substances of the electrochemically reversible redox system, but also, in the case of a copper deposition bath using Fe(II)/Fe(III) compounds as substances of the electrochemically reversible redox system, by the oxygen from the air contained in the electrolyte fluid.

Moreover, it has also been found out that the oxidized substances of the electrochemically reversible redox system are not only reduced in the metal ion generator but also at the cathode in the precipitation tank, so that the cathodic current efficiency merely amounts to approximately 90%.

On account of the reasons mentioned above, a stationary condition between the formation of metal ions in the metal ion generator and the consumption of the metal ions by way of electrolytic metal deposition does not arise. This effect is still reinforced, specifically when using a higher temperature. Therefore, the content of the metal ions to be deposited in the electrolyte fluid increases continuously. However, the content of the metal ions has to be kept within narrow limits in order to keep up enough good physical properties of the deposited coatings of metal.

Among other indications, WO 9910564 A2 asserts in this connection that it is not possible to lower the metal ion concentration in the electrolyte fluid in an additional electrolytic secondary cell utilizing an insoluble anode in a manner which is well-known in conventional electroplating plants utilizing soluble anodes instead of the insoluble anodes employed here. The problem herewith, according to said document, is that the substances of the electrochemically reversible redox system are oxidized at the anode of the secondary cell so that the content of the oxidized species of these substances rises in the fluid. It maintains that, as a result thereof, the metal ion content in the electrolyte fluid continues to rise so that the actual goal aiming at lowering the metal ion concentration is missed.

The document mentioned additionally indicates another approach in overcoming the problem that involves diluting permanently the electrolyte fluid. But since this would entail that large quantities of the fluid would continuously have to be discarded and disposed of, this procedure, which is also known under the name of, feed and bleed method, is said to be unsatisfactory.

According to this document, the solution of the problem consists in suggesting a method and a device for regulating the metal ion concentration. According to this solution, at least one portion of the electrolyte fluid contained in the electroplating plant is guided through one or several electrolytic auxiliary cells provided with at least one insoluble anode and at least one cathode and a flow of current is set between the anodes and the cathodes of the auxiliary cells, said flow of current being so high that the current density at the surface of the anode amounts to at least 6A/dm' and the current density at the surface of the cathode to no more than 3 A/dm? The ratio of the surface of the anodes to the surface of the cathodes is set to at least 1:4.

By means of this arrangement the metal ion content in the electrolyte fluid can be kept constant over a longer period of time by allowing part of the oxidized species of the electrochemically reversible redox system contained in the electrolyte fluid to be reduced at the cathode of the auxiliary cell. In adjusting the ratio of the current densities at the anode and at the cathode in the auxiliary cell by selecting for example the suitable relationship between the surfaces of the anode and of the cathode, the reduced species of the electrochemically reversible redox system at the anode of the auxiliary cell are oxidized merely to a minor extent or not at all so that the concentration of the oxidized species of the electrochemically reversible redox system can be regulated, which permits to directly influence the rate of formation of the metal ions.

The device described in WO 9910564 A2 proved however to be quite complicated since the precipitation tank has to be provided with several secondary cells. It is question of the auxiliary cell mentioned and of the metal ion generator. In production plants, it may be necessary to provide for a plurality of auxiliary cells and metal ion generators. Moreover, metal continuously deposits onto the cathode in the auxiliary cell so that the efficiency of the reduction of the oxidized species of the electrochemically reversible redox system continuously decreases at the cathode, thus requiring an increased electrical power. The rectifiers used for the purpose of supplying the auxiliary cell with current have to be provided with an increased rated capacity, which adds to the prime costs. Moreover, the duration of life of this device is limited on account of corrosive attack of the anode material.

Furthermore, the copper deposited on the cathode of the auxiliary cell has to be electrochemically removed from time to time which implies additional consumption of energy and non availability of the device for this period of time. Accordingly, several such auxiliary cells have to be provided to ensure continuous production, some of these cells being utilized for regulating the metal ion concentration while in other parallelled auxiliary cells the copper is being removed from the cathode. The particular disadvantage thereof is that the cathode material that is customarily employed is damaged in the stripping procedure. As a result thereof, the efficiency of reduction is reduced on one hand. On the other, the cathode has to be replaced by a new one after some stripping procedures.

Accordingly, the basic problem the present invention is dealing with is to overcome the drawbacks of the known methods and devices and to more specifically discover a device and a method that permit an economical way of operation of the procedure of electrolytic deposition. More specifically, the process of electrolytic deposition is intended to use insoluble anodes and substances of an electrochemically reversible redox system in the electrolyte fluid. The method is intended to be capable of being performed under constant conditions over a very long period of time. The metal ion concentration in the electrolyte fluid in particular has to be kept constant within narrow limits over said period of time. The invention is above all directed to permit to keep the metal ion concentration constant with simple means merely requiring low consumption of energy and low prime costs.

SUMMARY OF THE INVENTION

The method according to the invention serves to regulate the metal ion concentration in an electrolyte fluid serving to electrolytically precipitate metal and additionally containing substances of an electrochemically reversible redox system in an oxidized and reduced form. It comprises the following steps:

a. having at least one portion of the electrolyte fluid guided through at least one auxiliary cell, each cell being provided with an insoluble auxiliary anode and with at least one auxiliary cathode, b. producing a flow of current between the auxiliary cathodes and the auxiliary anodes of the auxiliary cell by applying a voltage; and c. using pieces of the metal to be deposited for acting as auxiliary cathodes.

For this purpose, the electrolyte fluid is continuously conducted through the plant in which metal is electrolytically deposited and through the auxiliary cells in such a way that the fluid flows concurrently or, if need be, subsequently through the plant and the cells at least from time to time. After the fluid has flown through the auxiliary cells it is brought back to the plant over and over again.

For electrolytic deposition of the metal, said metal is deposited onto the work from the electrolyte fluid using at least one insoluble main anode which is preferably provided with dimensional stability. For this purpose, an electric current is passed between the work and the main anode. The metal ions are formed by the substances of the redox system in the oxidized form in at least one metal ion generator through which the electrolytic fluid at least partially flows and which serves as an auxiliary cell in causing the metal pieces to dissolve. To this effect, the substances in the oxidized form are converted to the reduced form in producing corresponding substances such as metal ions. The thus produced substances in the reduced form are oxidized again at the main anode in producing the corresponding substances in the oxidized form.

The device according to the invention therefore is a metal ion generator serving as an electrolytic auxiliary cell a. which can be filled with pieces of the metal to be deposited and b. which is provided with at least one insoluble auxiliary anode and at least one power supply, preferably a source of direct current, for generating a flow of current between the auxiliary anode and the metal pieces that can be filled in, c. wherein the metal pieces can be used as auxiliary cathodes.

Preferably, the anode spaces surrounding the auxiliary anodes and the cathode spaces surrounding the metal pieces are separated from each other by means that are at least partially permeable to ions. If necessary, the at least partially ion permeable means between the anode spaces and the cathode spaces may also be relinquished, though. In this event, the auxiliary cathodes are accommodated in a section of the metal ion generator in which the fluid has been appeased in order to prevent at least as far as possible the electrolyte fluid contained in the cathode space from mixing with the electrolyte fluid in the anode space. From a constructional point of view, the two spaces may be separated from each other in such a manner for example that mixing hardly occurs. The metal pieces are preferably accommodated in a compartment of the metal ion generator that has a very good through-flow.

With the inventive method and device, which more specifically serve to regulate the copper ion concentration in a copper deposition solution serving to electrolytically deposit copper and additionally containing Fe(II) and Fe(III) compounds, the metal ion content in a metal deposition solution can be kept constant within narrow limits so that reproducible conditions can be considerably lower. Furthermore, the deposition solution does not come into contact with an inert auxiliary cathode as this is the case with the plant described in WO 9910564 A2, so that a potential deposit of metal onto the auxiliary cathode cannot cause the problems discussed herein above. Accordingly, the method according to the invention does without substantial maintenance works such as e.g., the intermediary stripping of the metal deposited onto the auxiliary cathode as required by the prior art device, over a very long period of time. The problem created thereby, namely a reduction of the efficiency of the conversion of the oxidized substances of the redox system into the reduced substances on account of a metal coating formed on the auxiliary cathode, does not occur when using the present invention.

The lower the content of the substances of the redox system in the oxidized form in the electrolyte has an additional advantage; the work in the electroplating plant is located in an electrolyte fluid that contains a reduced concentration of the substances of the redox system in the oxidized form when performing the method according to the invention. An accordingly reduced quantity of the substances of the redox system is reduced by the electroplating current on the surface of the work. As a result thereof, the cathodic current efficiency in the electroplating plant is improved. The correlated gain of production capacity amounts to up to 10%.

A further advantage of the invention is that the anode slime known from electroplating plants with soluble anodes does not occur. In parts, a ,feed a bleed operation of the plant may nevertheless be useful. This is particularly true when organic and/or inorganic additives in the electrolyte fluid are to be exchanged in the long run. As a result of the partial discard of electrolyte fluid, the content of the oxidized metal ions of the redox system is lowered proportionally. The capacity of the metal ion generator may be reduced by this portion. Accordingly, the metal ion content can also be kept constant by having substances of the redox system in the oxidized form reduced in the metal ion generator and concurrently, by having part of the electrolyte fluid removed from the electroplating plant and replaced by a fresh electrolyte fluid.

Inert metal electrodes that have been activated with precious metals and/or with mixed oxides, maintained for deposition. The metal deposition solution is continuously conducted from the electroplating plant, e.g., a precipitation tank into the metal ion generator of the invention and from there back again into the electroplating plant. The substances of the redox system that formed in the oxidized form at the main anode in the electroplating plant are reduced again at the metal pieces in the metal ion generator, thereby forming metal ions. Due to the fact that the rate of formation of the substances of the redox system in the reduced form in the metal ion generator can be varied by having the metal pieces provided with a cathodic polarity relative to an auxiliary anode, the rate of formation of the metal ions in the metal ion generator can be regulated. Another oxidation of the reduced substances of the redox system relative to the oxidized substances at the auxiliary anode is largely prevented from taking place in having the anode space surrounding the auxiliary anode separated from the cathode space surrounding the metal pieces. The fluids in the anode space and in the cathode space are largely prevented from mixing so that the reduced substances of the redox system can reach the auxiliary anode to a very little extent only since these substances can reach the auxiliary anode only by diffusion and since the concentration of the substances in the anode space depletes on account of the electrochemical reaction taking place there.

In regulating the flow of current in the metal ion generator, the production rate of the substances of the redox system in the reduced form and thus subsequently the rate of formation of the metal ions in the metal ion generator is set to a value which is so large that the quantity of metal ions produced per unit time by oxidation with the redox compounds plus the quantity generated by the dissolution of the metal on account of the oxygen from the air entered in the electrolyte fluid equals the quantity of the metal ions used up at the cathode in the electroplating plant. As a result thereof, the total content of ions of the metal to be deposited in the electrolyte fluid remains constant. In using the method according to the invention the desired stationary condition between the formation of metal ions and their consumption is achieved.

As compared to the invention described in WO 9910564 A2, the further advantage of the inventive method and device is that merely one or several secondary cells have to be provided in addition to the electroplating plant and not one or several auxiliary cells and one or several additional metal ion generators. As a result thereof, the expenses for plant engineering are more specifically of precious metals, are preferably used. This material is chemically and electrochemically stable relative to the deposition solution and the substances of the redox system used. The basis material used is titanium or tantalum for example. The basis material is preferably used as perforated electrode material, in the form of rib mesh metal or nets, in order to offer a large surface when little place is available. Since these metals have a considerable overpotential when electrochemical reactions take place, the basis materials are coated with a precious metal, preferably with platinum, iridium, ruthenium or their oxides or mixed oxides. As a result thereof, the basis material is additionally protected against electrolytic stripping. Anodes of titanium coated with iridium oxide that are exposed to radiation by spherical bodies to become compressed so as to become free from pores are permanent enough, thus being provided with a long useful life at the conditions applied.

Metal pieces shaped like balls are preferably used. Copper needs not to contain phosphorus as this is the case when using soluble copper anodes. As a result thereof, the formation of anode slime is diminished. Metal balls have the advantage that a reduction in volume of the ball's bulk in the metal ion generator does not easily cause hollow spaces acting as bridges to form when the metal pieces are dissolving so that it is easier to fill up with new metal pieces. By using balls having an appropriate diameter, the bulk volume in the metal ion generator may be optimized. Again, as a result thereof, the flow resistance or, when the pumping capacity is given, the volume flow of the deposition solution is determined by the formed bulk of the metal balls. However, the metal pieces may also be substantially cylindrical or cuboid in shape. It has to be made sure that the flow through the cathode space is sufficient.

In order to further diminish an oxidation of substances of the redox system in the reduced form entering the anode space, the ratio of the surface of the metal pieces to the surface of the at least one auxiliary anode is set to a value of at least 4:1. As a result thereof, the current density at the auxiliary anode is increased so that preferably the water of the deposition solution oxidizes, forming oxygen in the process, and the substances of the redox system in the reduced form only oxidize to a minor extent. A surface ratio of at least 6:1 is preferred, even more preferred being a surface ratio of at least 10:1. Ratios of at least 40:1 are more specifically preferred, above all a ratio of at least 100:1. Such a high surface ratio can be adjusted in selecting for example small metal pieces, more specifically metal balls having a small diameter. Typically, a cathodic current density of 0.1 $A/dm^2$ to 0.5 $A/dm^2$ and an anodic current density of 20$A/dm^2$ ensues. At these conditions, virtually oxygen alone is formed at the anode. Substances of the redox system in the reduced form possibly present in the anode space are virtually not oxidized at these conditions.

The metal ion generator can preferably be shaped like a tube. In this case, an advantageous embodiment consists in having the auxiliary anode accommodated above the space that can be occupied by the metal pieces. As a result thereof, the oxygen set free by the anodic decomposition of the water at the auxiliary anode can escape from the deposition solution in the metal ion generator without contacting the metal pieces and without coming into close contact with the solution so that it dissolves in the solution in appreciable quantities, thus reaching the metal pieces. This arrangement allows to prevent the metal pieces from dissolving faster under the action of the oxygen.

In an alternative, advantageous embodiment, the metal ion generator may be vertically partitioned into two compartments (anode space and cathode space), the metal pieces being accommodated in the one compartment and the at least one auxiliary anode being arranged in the other compartment. In this case too, oxygen originated at the auxiliary anode emerges from the deposition solution without further contacting the metal pieces.

The bulk of the metal pieces preferably rests on an electrode that has the shape of a sieve and consists of an inert material such as titanium for example. The power can be delivered to the metal pieces by way of this electrode. Thanks to the sieve shape of said electrode, the deposition solution can be passed through the sieve to the metal bulk through which it can be delivered. Reproducible flow conditions are thus set in the metal bulk. The deposition solution entering the cathode space can be exited out of the cathode space by being caused to overflow upon flowing through the metal bulk in the upper region of the cathode space. Thanks to the high flow rate set by the bulk, the efficiency of the reduction of the substances of the redox system in the oxidized form at the metal pieces can be increased since the concentration overpotential for these substances at the pieces is reduced.

The auxiliary anode is surrounded by an anode space and the metal pieces by a cathode space, the deposition solution being located in said spaces. The two spaces are separated from each other by means that are at least partially permeable to ions. Liquid permeable, nonconducting woven cloths such as polypropylene cloth for example may preferably be used as ion permeable means. This material hampers convection between the electrolyte spaces.

In an alternative embodiment, ion exchange membranes may be utilized. These membranes have the additional advantage not only to hamper convection between electrolyte spaces but selectively, migration as well. When utilizing an anion exchange membrane for example, anions coming from the cathode space can arrive into the anode space whereas cations coming from the anode space cannot get into the cathode space. In the event a copper deposition solution with $Fe^{2+}$ and $Fe^{3+}$ ions is employed, the $Fe^{3+}$ ions formed by oxidation in the anode space are not transferred into the cathode space so that the efficiency of the device according to the invention is not impaired. If these ions were transferred into the cathode space, the $Fe^{3+}$ ions would be reduced to $Fe^{2+}$ ions in a reaction competing with the $Cu^{2+}$ reduction. That is why ion exchange membranes used as at least partially ion permeable means are particularly advantageous from a technical point of view. However, these materials are more expensive and mechanically more sensitive than the woven cloths that are permeable to liquid.

The metal ion concentration in the deposition solution can be regulated by adjusting the current conduction between the auxiliary anode and the pieces of metal. For this purpose, the current is controlled by way of the electric power supply. A sensor may be additionally provided for the automatic control of the metal ion content, the metal ion concentration in the solution being measured continuously by means of said sensor. For this purpose, the extinction of the deposition solution may be determined by photometry in a separate gauge head in which the solution is circulated and the output signal of the gauge head can be brought to a comparator. The thus obtained regulating variable can then be converted into an actuating variable for adjusting the current to the power supply. This current serves to influence primarily the content of substances of the redox system in the electrolyte fluid. This content again influences the rate of dissolution at the metal pieces.

From the electroplating plant, in which the inert main anodes and the work to be plated are located, the electrolyte fluid is delivered in a forced circulation to the metal ion generator from where it is returned to the electroplating plant. Pumps are utilized for this purpose which convey the fluid in the forced circulation through appropriate pipelines. If necessary, a reservoir is employed as well and is arranged between the electroplating plant and the metal ion generator. This reservoir serves to store the electrolyte fluid for several precipitation tanks operated in parallel in an electroplating plant for example. For this purpose, two liquid cycles can be formed, the one being formed between the precipitation tanks and the reservoir and the second between the reservoir and the metal ion generator. Moreover, filtering means can also be inserted in the cycle in order to remove impurities from the electrolyte fluid. On principle, the metal ion generator may also be placed in the very precipitation tank in order to achieve the shortest possible flow paths.

The invention is preferably suited for regulating the concentration of the copper ion content in copper baths using inert anodes of dimensional stability in the precipitation tank, said baths containing $Fe^{2+}$ and $Fe^{3+}$ salts, preferably $FeSO_4/Fe_2(SO_4)_3$ or $Fe(NH_4)_2(SO_4)_2$ or other salts for the purpose of maintaining the concentration of the copper ions. On principle, the invention can also be utilized in regulating the metal ion concentration in baths serving to electrolytically deposit other metals such as e.g., zinc, nickel, chromium, tin, lead and the alloys thereof and with other elements such as e.g., phosphorus and/or boron. In this event, other substances of an electrochemically reversible convertible redox system have possibly to be used, the redox system being chosen in dependence on the respective precipitation potential. Compounds of the elements titanium, cerium, vanadium, manganese, chromium for example may also be used. Suitable compounds are titanyl sulfuric acid, cerium(IV) sulfate, alkali metavanadate, manganese(II) sulfate and alkali chromate or alkali dichromate for example.

The method and the device according to the invention are particularly suited for use in horizontal through-type electroplating plants in which plate-shaped work, preferably printed circuit boards, which is horizontally or vertically positioned, is conveyed in a linear manner in horizontal direction while being brought into contact with the electrolyte fluid. As a matter of fact, the method can also be used for electroplating work in traditional dip plants in which the work is in most cases submerged in vertical orientation.

In the following, the invention is explained in more detail with the help of the Figures.

BRIEF DESCRIPTION OF THE DRAWING FIGURES

Figure 2:
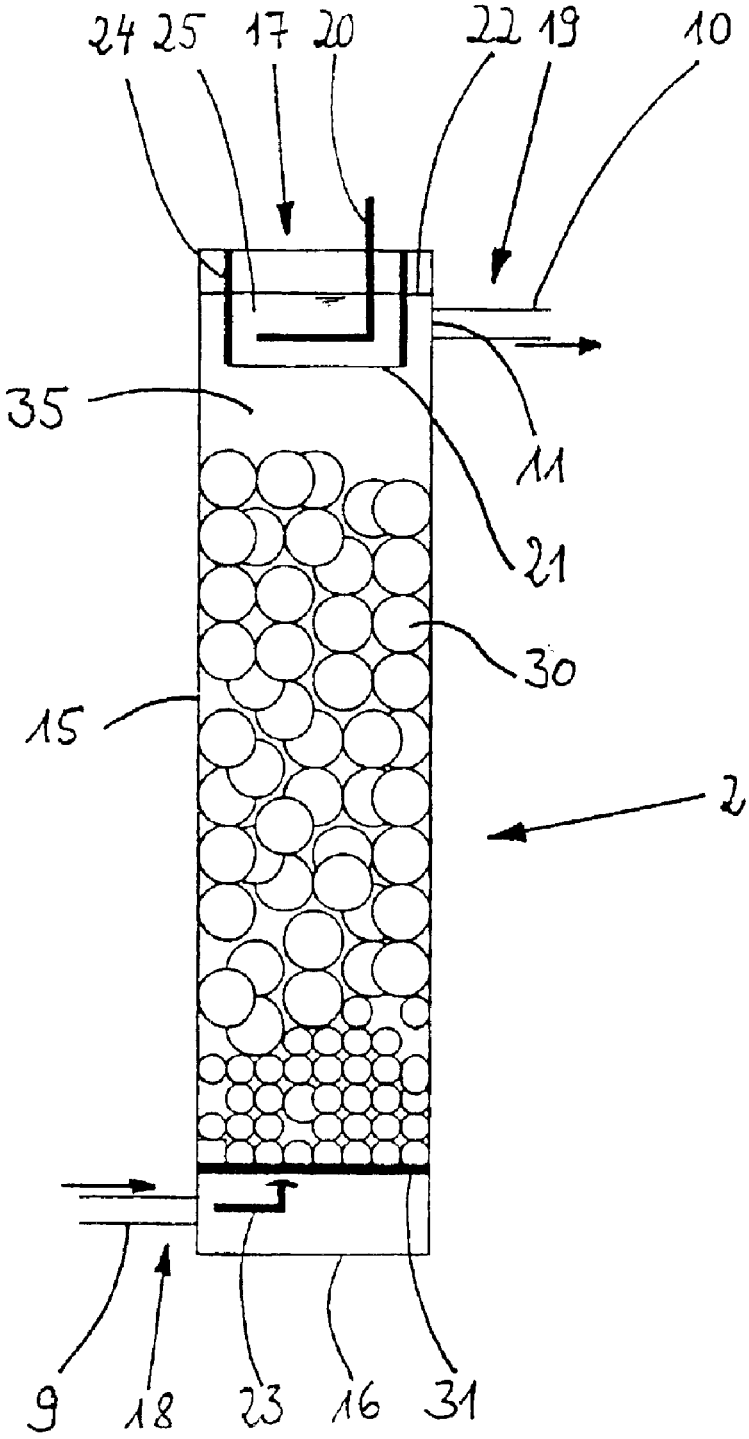
Figure 3:
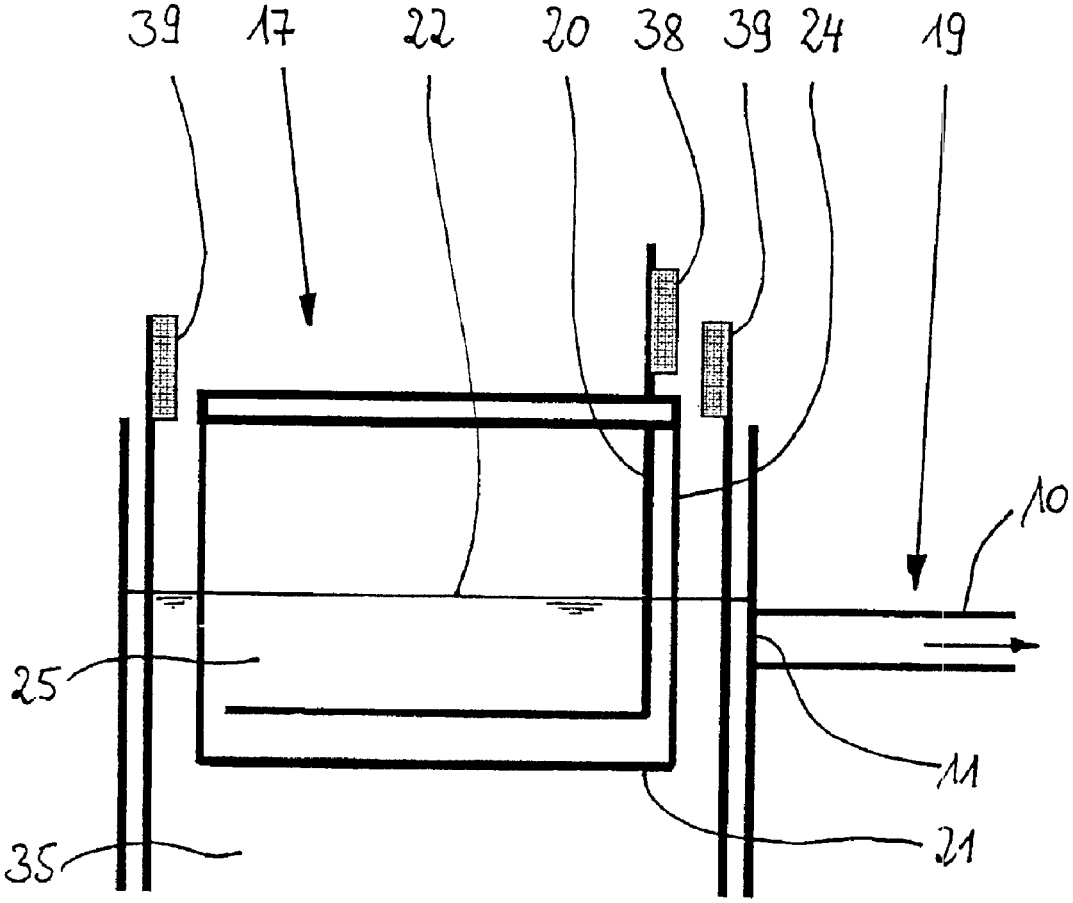
Figure 4:
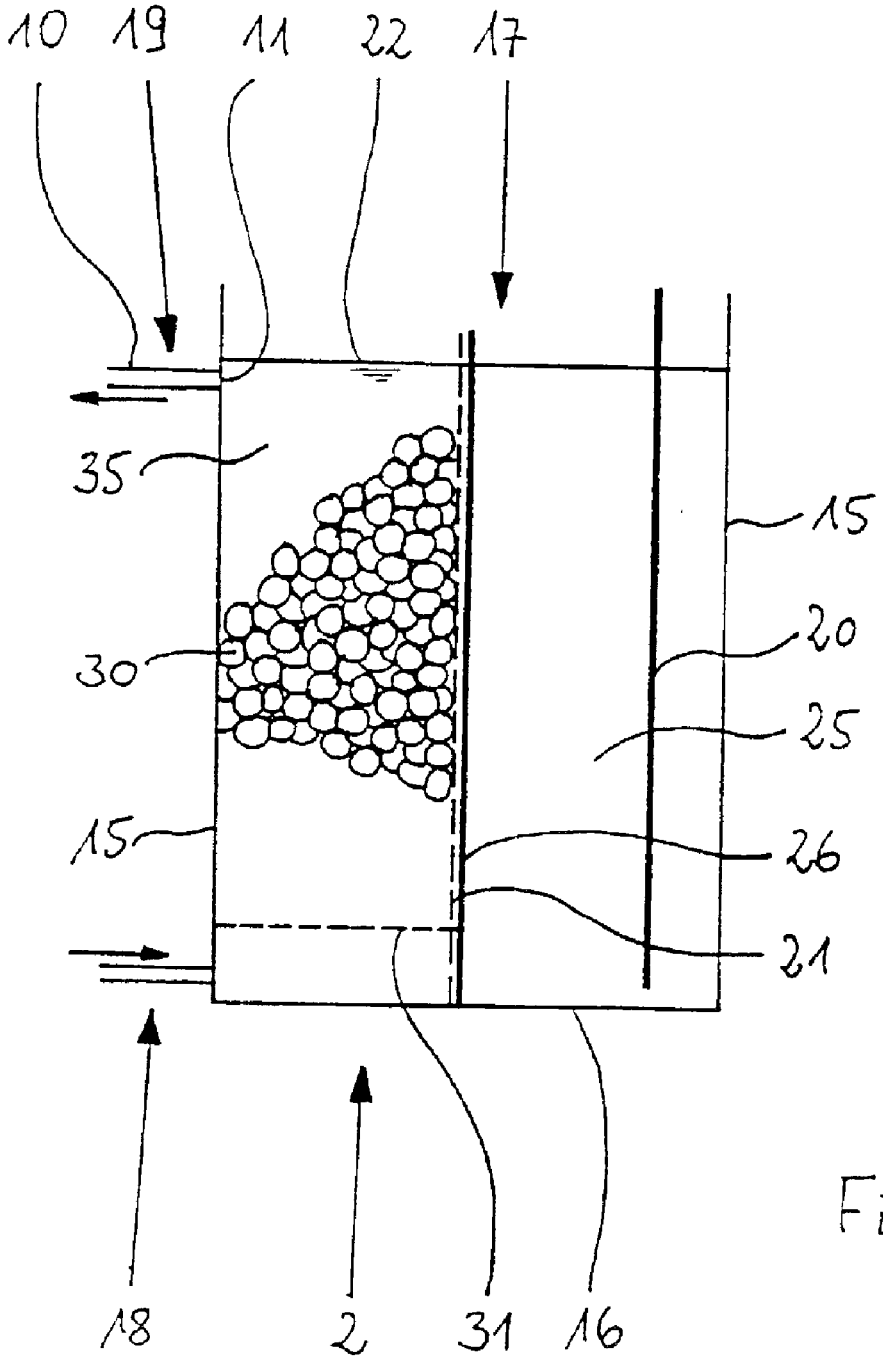

FIG. 1: shows a diagrammatic view of an arrangement for electroplating;

FIG. 2: shows a sectional view of the metal ion generator in a first embodiment;

FIG. 3: shows a sectional view of the upper region of the metal ion generator in a first embodiment;

FIG. 4: shows a sectional view of the metal ion generator in a second embodiment.

DETAILED DESCRIPTION OF THE PREFERRED EMBODIMENTS

FIG. 1 shows a diagrammatic view of an electroplating arrangement provided with a precipitation tank 1, a metal ion generator 2 and a reservoir 3. The precipitation tank 1 may be of the through-type for treating printed circuit boards, a sump being preferably provided out of which electrolyte fluid is taken to be splashed or sprayed onto or brought into contact in any other way with the printed circuit boards and to which it is returned after contact with the printed circuit boards. In this case, the tank 1 shown in FIG. 1 is the sump.

The discrete receptacles are filled with the electrolyte fluid. A sulphuric acid copper bath can be utilized as electrolyte fluid, said bath containing copper sulfate, sulphuric acid and sodium chloride as well as organic and inorganic additives for controlling the physical properties of the metal deposited.

The metal ion generator 2 contains an auxiliary anode 20 and pieces of metal 30. The metal pieces 30 (a portion thereof only being illustrated) rest as a bulk on a sieve bottom 31 made of titanium. The sieve bottom 31 and the auxiliary anode 20 are connected to a direct current supply 50 by way of electric feed lines 40, 41. The sieve bottom 31 has cathodic polarity and is therefore connected to the negative terminal of the power supply 50. The auxiliary anode 20 has anodic polarity and is connected to the positive terminal of the power supply 50. The metal pieces 30 are also given cathodic polarity via the electric contact of the metal pieces 30 with the sieve bottom 31, a current being conducted between the metal pieces 30 and the auxiliary anode 20 as a result thereof. An ion permeable polypropylene woven cloth 21 is clamped between the anode space 25 surrounding the auxiliary anode 20 and the cathode space 35 containing the metal pieces 30 in order to prevent the convective transport of fluid between the spaces 25 and 35.

The precipitation tank 1 communicates with the reservoir 3 in a first liquid cycle: electrolyte fluid is drawn from the upper region of the precipitation tank 1 through the pipeline 4 and is transferred to the reservoir 3. The fluid may be drawn from the precipitation tank 1 through an overflow compartment for example. The fluid contained in the reservoir 3 is drawn from the lower region of the receptacle through a pipeline 5 by means of a pump 6 and is channelled through a filter unit 7, e.g., taped filter candles. The filtered solution is returned to the precipitation tank 1 via the pipeline 8.

The reservoir 3 also communicates with the metal ion generator 2 via a second liquid cycle: fluid is taken from the bottom of the reservoir 3 through the pipeline 9 and is caused to enter the metal ion generator 2 in the lower region underneath the sieve bottom 31. The fluid is drawn out of the metal ion generator 2 again by way of an overflow in the upper region of the cathode space 35 and is returned to the reservoir 3 through the pipeline 10.

FIG. 2 shows a section of a first embodiment of the metal ion generator 2. The metal ion generator 2 consists of a tubular housing 15 which is made of polypropylene for example and which is provided with a bottom 16 made e.g., of polypropylene too. On its upper front side, the tubular housing 15 is provided with an opening 17. A fluid admission 18 for the electrolyte fluid is provided in the lower region of the tubular housing 15. Correspondingly, a fluid outlet 19 is arranged in the upper region. The cross section of the tubular housing 15 is preferably rectangular, square or circular.

In the metal ion generator 2 there are located an anode space 25 and a cathode space 35.

The anode space 25 and the cathode space 35 are separated from each other by a wall 24 and by an ion permeable woven cloth 21, a polypropylene cloth in this case, that is fastened to the lower border of the wall 24. This is shown in detail in FIG. 3. As a result, the convective transport of fluid between the two spaces 25 and 35 is checked to a large extent. The wall 24 forms an upper opening and is fastened to the upper front-sided edge of the tubular housing 15 (not shown).

The auxiliary anode 20 is accommodated in the anode space 25. The cathode space 35 contains the metal pieces 30, copper balls in this case, that do not contain any phosphorus and that have a diameter of approximately 30 mm for example. The copper balls 30 form a bulk resting on a titanium sieve 31 in the lower region of the tubular housing 15. The auxiliary anode 20 is connected to the positive terminal and the sieve bottom 31 to the negative terminal of a direct current supply. The place of screwed union 38 for the anodic power lead from the source of direct current to the auxiliary anode 20 and the cathodic place of screwed union 39 for the power lead to the sieve bottom 31 are illustrated schematically in FIG. 3. In this event, the electric feed lines for the sieve bottom 31 are insulated and guided upward out of the metal ion generator 2.

The pipe 9 leads into the metal ion generator 2 via the fluid intake 18. The fluid intake 18 is provided underneath the sieve 31. The sieve prevents pieces of metal or slime from obstructing the pipe 9. The metal ion generator 2 furthermore communicates with the pipe 10 at the fluid outlet 19. The fluid outlet 19 is arranged in the upper region of the metal ion generator 2. In order to make certain that the metal ion generator 2 is always filled up to the liquid level 22, the fluid outlet 19 is designed as a pipeline 10 that exits the tubular housing 15 and is provided with an exhaust port 11 in the upper region of the cathode space 35. The electrolyte fluid can exit the cathode space 35 through the exhaust port 11 into the pipeline 10. Said exhaust port 11 is arranged above the level of the auxiliary anode 20, thus ensuring that the auxiliary anode 20 is always situated within the fluid.

The electrolyte fluid that comes from the reservoir 3 or directly from the deposition tank 1 and that contains, in addition to the copper ions, $Fe^{3+}$ ions and possibly additionally $Fe^{2+}$ ions formed at the main anode, is pumped into the metal ion generator 2 via the fluid intake 18. The fluid then traverses the sieve bottom 31 in the direction of the arrow 23 and enters the cathode space 35 containing the copper balls 30. The $Fe^{3+}$ ions react with the copper to form $Cu^{2+}$ ions while $Fe^{2+}$ ions are produced at the same time. The rate of formation of the copper ions can be regulated by giving the copper balls 30 cathodic polarity via the sieve bottom 31: increasing the cathodic potential at the copper balls 30 forces back the rate of formation of the $Cu^{2+}$ ions. The solution, enriched with $Cu^{2+}$ ions, exits the metal ion generator 2 in the upper region of the cathode space 35 through the port 11 via the fluid outlet 19. The electrochemical reaction is made possible by applying a cathodic potential to the sieve bottom 31 and accordingly to the copper balls 30 and an anodic potential to the auxiliary anode 20 in the anode space 25. The water of the electrolyte fluid contained in the anode space 25 is anodized liberating oxygen, said oxygen exiting the upper region of the metal ion generator 2 through the opening 17. If necessary, $Fe^{2+}$ ions contained in the anode space 25 are oxidized as well at the auxiliary anode 20. Since the exchange of fluid between the cathode space 35 and the anode space 25 is strongly impaired by the separation 21, 24, the $Fe^{2+}$ ions deplete in the anode space 25 so that their concentration in stationary operation comes near zero.

FIG. 4 shows a second embodiment of the metal ion generator 2 according to the invention. In this case, the metal ion generator 2 is a receptacle with side walls 15 which form a rectangular, square or circular ground plan of the metal ion generator 2. The receptacle is furthermore provided with a bottom 16. The walls 15 and the bottom 16 are made of polypropylene. The metal ion generator 2 forms an opening 17 at its top.

The metal ion generator 2 again is provided with a cathode space 35 and an anode space 25. Furthermore, the spaces 25 and 35 are separated from each other by an ion permeable wall 21, an ion exchange membrane in this case, preferably an anion exchange membrane, which is vertically arranged. A perforated wall 26 is also provided, which endows the membrane with the required stability.

A sieve bottom 31 is arranged in the lower region in the cathode space 35, said sieve bottom being constituted by a titanium net. A bulk of metal pieces 30 (shown only in parts) rests on the sieve bottom 31, the metal pieces here being copper balls having a diameter of approximately 30 mm. An auxiliary anode 20 is accommodated in the anode space. The auxiliary anode 20 is connected to the positive terminal and the sieve bottom 31 to the negative terminal of a direct current supply (not shown).

The electrolyte fluid can enter the metal ion generator 2 through the lower fluid intake 18. The fluid intake 18 is arranged underneath the sieve bottom 31. Fluid can exit the metal ion generator 2 again through an upper fluid outlet 19. The outlet 19 is arranged in the upper region of the cathode space 35.

The way of operation of the metal ion generator 2 in this embodiment corresponds to that of the first embodiment shown in the FIGS. 2 and 3. In this respect, reference is made to the explanations given herein above.
to be deposited as an auxiliary cathode.

List of numerals:

| | |
|---|---|
| 1 | precipitation tank |
| 2 | metal ion generator |
| 3 | reservoir |
| 4, 5, 8, 9, 10 | pipelines |
| 6 | pump |
| 7 | filtering unit |
| 11 | exhaust port |
| 15 | tubular housing of the metal ion generator 2 |
| 16 | bottom of the metal ion generator 2 |
| 17 | front-sided upper opening of the metal ion generator 2 |
| 18 | fluid intake into the metal ion generator 2 |
| 19 | fluid outlet out of the metal ion generator 2 |
| 20 | auxiliary anode |
| 21 | ion permeable means (woven cloth) |
| 22 | fluid level |
| 23 | direction of flow of the electrolyte fluid |
| 24 | wall separating the anode space 25 from the cathode space 35 |
| 25 | anode space |
| 26 | perforated wall |
| 30 | pieces of metal, copper balls |
| 31 | sieve bottom, titanium net |
| 35 | cathode space |
| 38 | electrical contact for leading power to the auxiliary anode 20 |
| 39 | electrical contact for leading power to the sieve bottom 31 |
| 40 | electric feed line to the auxiliary anode 20 |
| 41 | electric feed line to the sieve bottom 31 |
| 50 | power supply, direct current source |

What is claimed is:

1. Method for regulating the metal ion concentration in an electrolyte fluid serving to electrolytically deposit metal and additionally containing substances of an electrochemically reversible redox system in an oxidized and in a reduced form in which at least one portion of the electrolyte fluid is conducted through at least one auxiliary cell, each cell being provided with at least one insoluble auxiliary anode and at least one auxiliary cathode, a current being conducted between them by applying a voltage, wherein pieces of the metal (30) to be deposited are used as at least one auxiliary cathode.

2. Method according to claim 1, wherein anode spaces (25) surrounding the auxiliary anodes (20) and cathode spaces (35) surrounding the metal pieces (30) are separated from one another by means (21) that are at least partially permeable to ions.

3. Method according to one of the previous claims, wherein inert metal electrodes that have been activated with precious metals and/or mixed oxides are used as insoluble auxiliary anodes (20).

4. Method according to one of the previous claims, wherein the metal pieces (30) are used in the form of balls.

5. Method according to one of the previous claims, wherein the ratio of the surface of the metal pieces (30) to the surface of the at least one auxiliary anode (20) is set to a value of at least 4:1.

6. Method according to one of the previous claims, wherein the auxiliary cell (2) is designed as a tubular metal ion generator and that the at least one auxiliary anode (20) is arranged above the metal pieces (30).

7. Method according to one of the claims 1 through 5, wherein the auxiliary cell (2) is designed as a metal ion generator and is partitioned by vertical division into an anode space (25) and a cathode space (35), the metal pieces (30) being arranged in the cathode space (35) and the at least one auxiliary anode (20) in the anode space (25).

8. Method according to one of the previous claims, wherein current is fed to the metal pieces (30) via a sieve-shaped electrode (31).

9. Method according to one of the previous claims, wherein the at least partially ion permeable means (21) is designed as a woven cloth that is permeable to liquid.

10. Method according to one of the claims 1 through 8, wherein an ion exchange membrane is used as an ion permeable means (21).

11. Device for regulating the metal ion concentration in an electrolyte fluid serving to electrolytically deposit metal and additionally containing substances of an electrochemically reversible redox system in an oxidized and in a reduced form, comprising a. at least one insoluble auxiliary anode, b. at least one auxiliary cathode as well as c. at least one power supply for conducting a current flow between the at least one auxiliary anode and the at least one auxiliary cathode, wherein the device contains pieces of the metal (30) to be deposited acting as auxiliary cathodes.

12. Device according to claim 11, wherein means (21) are provided that are at least partially permeable to ions, said means separating anode spaces (25) surrounding the auxiliary anodes (20) from cathode spaces (35) in which the metal pieces (30) may be filled.

13. Device according to claims 11 and 12, wherein the insoluble auxiliary anodes (20) are inert metal electrodes that have been activated with precious metals and/or mixed oxides.

14. Device according to one of the claims 11 through 13, wherein the metal pieces (30) are metal balls.

15. Device according to one of the claims 11 through 14, wherein the ratio of the surface of the metal pieces (30) to the surface of the at least one auxiliary anode (20) amounts to at least 4:1.

16. Device according to one of the claims 11 through 15, wherein the device (2) is designed as a tubular metal ion generator and wherein the at least one auxiliary anode (20) is arranged above a space containing the metal pieces (30).

17. Device according to one of the claims 11 through 15, wherein the device (2) is vertically divided into the anode space (25) and the cathode space (35), whereas the metal pieces (30) can be filled into the cathode space (35) and the at least one auxiliary anode (20) is arranged in the anode space (25).

18. Device according to one of the claims 11 through 17, wherein a sieve-shaped electrode (31) is arranged in the cathode space (25) in such a way that the metal pieces (30) can be supplied with current via this electrode (31).

19. Device according to claim 18, wherein the sieve-shaped electrode (31) is arranged in the lower portion of the cathode space (35) in such a manner that the metal pieces (30) can rest upon said electrode.

20. Device according to one of the claims 11 through 19, wherein the at least partially ion permeable means (21) is designed as a woven cloth that is permeable to liquid.

21. Device according to one of the claims 11 through 19, wherein the at least partially ion permeable means (21) is an ion exchange membrane.

22. Application of the method according to one of the claims 1 through 10 for regulating the copper ion concentration in a copper deposition solution serving to electrolytically deposit copper and additionally containing Fe(II) and Fe(III) compounds.

23. Use of the device according to one of the claims 11 through 21 for regulating the copper ion concentration in a copper deposition solution serving to electrolytically deposit copper and additionally containing Fe(II) and Fe(III) compounds.

* * * * *